US005886459A

United States Patent [19]

Auciello et al.

[11] Patent Number: 5,886,459

[45] Date of Patent: Mar. 23, 1999

[54] ENHANCED FIELD EMISSION FROM MICROTIP STRUCTURES

[75] Inventors: Orlando H. Auciello, Cary, N.C.; Alan R. Krauss, Naperville, Ill.; Gary E. McGuire, Chapel Hill, N.C.; Dieter M. Gruen, Downer Grove, Ill.

[73] Assignee: The University of Chicago, Chicago, Ill.

[21] Appl. No.: 777,936

[22] Filed: Dec. 23, 1996

[51] Int. Cl.[6] ..... H01J 9/02

[52] U.S. Cl. ..... 313/310; 445/50

[58] Field of Search ..... 313/310, 309; 445/24, 50

[56] References Cited

U.S. PATENT DOCUMENTS

| | | | |
|---|---|---|---|
| 4,414,176 | 11/1983 | Krauss et al. . | |
| 5,089,292 | 2/1992 | MaCaulay et al. | 313/336 |
| 5,463,271 | 10/1995 | Geis et al. | 313/310 |
| 5,666,025 | 9/1997 | Geis et al. | 313/310 |

OTHER PUBLICATIONS

Article "Effects of Potassium and Lithium Metal Deposition on the Emission Characteristics of Splindt–type Thin–film Field Emission Microcathode Arrays," Talin, A.A., T.E. Feller and D.J. Devine, J. Vac. Sci. Technol. B., vol. 13, No. 2, pp. 448–451 (Mar./Apr. 1995).

Article "Beyond AMLCDs: Field Emission Displays?", Derbyshire, K., Solid State Technology (Nov. 1994) pp. 55–65.

*Primary Examiner*—Kenneth J. Ramsey

*Attorney, Agent, or Firm*—Emrich & Dithmar

[57] ABSTRACT

A method and system for manufacturing a field emission cathode having enhanced electron emission properties. The field emission cathode is prepared by providing a field emission substrate, an alkali metal alloy is formed at and below the exposed surface of the substrate, and a surface layer of alkali metal atoms are formed on the exposed surface by Gibbsian diffusion segregation action. If the monolayer, or surface layer, is desorbed, the diffusion action reestablishes the alkali metal surface layer thereby providing a stable alkali metal layer and enhanced electron emission characteristics.

12 Claims, 3 Drawing Sheets

ENHANCED FIELD EMISSION FROM MICROTIP STRUCTURES

The United States Government has rights in this invention pursuant to Contract W-31-109-ENG-38 between the U.S. Department of Energy and the University of Chicago.

The present invention is directed generally to a system and method for manufacturing field emission cathode materials with enhanced, stable emission properties. More particularly, the invention is concerned with a system and method of fabricating field emitter structures from alkali metal based materials or applying alkali metal-based layers to substrate materials such as semiconductors like silicon or GaAs or metals, like Mo, Ta, Cu, Al or W, or even insulators, for forming a field emitter. Fabrication of field emitter structures from alkali metal-based bulk materials can be accomplished by etching, controlled deposition or ion beam etching. In the case of alkali metal-based layers, the layer can be applied by various methodologies, such as ion beam sputtering, alkali metal ion implantation, alkali metal vapor deposition, ion beam etching of an alloy layer, and alloy film growth and lithography.

Examples of useful field emission substrates are semiconductors, insulators or metals for forming a layer on a field emission substrate, such as a microtip. However, utilization of such materials as a field emission substrate requires reduction of the large work function in order to render such field emission materials more useful as a field emitter. Direct adsorption of thin alkali metal layers onto these materials is expected to lower the work function and produce the desired increase in electron emission current, but the increase is short-lived since the electron emission results in rapid desorption of the alkali metal layer.

It is therefore an object of the invention to provide an improved system and method for manufacturing field emission components.

It is also another object of the invention to provide an improved system and method of manufacturing having an alkali metal-based coating for lowering the work function of field emission tips.

It is yet a further object of the invention to provide a novel system and method for making a field emission cathode substrate having a renewable source of alkali metal atoms for providing a surface emission layer exhibiting a reduced work function.

It is an additional object of the invention to provide an improved system and method for providing a microtip field emission tip of at least one of semiconductors, such as silicon, or metals, such as molybdenum, tantalum, copper, aluminum or tungsten, or even certain insulators, such as glasses, with an alkali metal alloy surface layer for reducing work function and enhancing field emission properties.

It is a further object of the invention to provide a novel system and method for manufacturing a field emission substrate with an alkali metal-based alloy prepared by one of a variety of methods including ion beam deposition, ion sputtering, vapor deposition, ion beam etching and thin film growth/lithography.

These and other objects of the invention will be described in detail in the detailed description provided herein below and taken in conjunction with the drawings described below.

DETAILED DESCRIPTION OF PREFERRED EMBODIMENTS

In general one can greatly enhance electron field emission properties for microtips or other field emission substrates by lowering the surface work function by establishing a stable or steady state composition of alkali metal atoms in the vicinity of the surface of a field emitter material. This alkali metal/substrate system can be established by applying thin films or coatings of the desired alkali metal containing material such as an alloy disposed on a fabricated field emission cathode substrate structure or by forming the substrate itself of an alkali metal-containing material. An enhanced electron field emission is obtained as a result of the formation of a self-replenishing, low work function alkali-metal rich surface layer by the well-known Gibbsian surface atomic segregation process.

As shown in FIGS. 1, 3, and 5–7, a variety of example methodologies can be used to establish the desired alkali metal-containing surface compositional state. These illustrate a limited set of methods for forming such alkali metal layers and other conventional methods are also contemplated to be within the scope of the invention.

Figure 1:
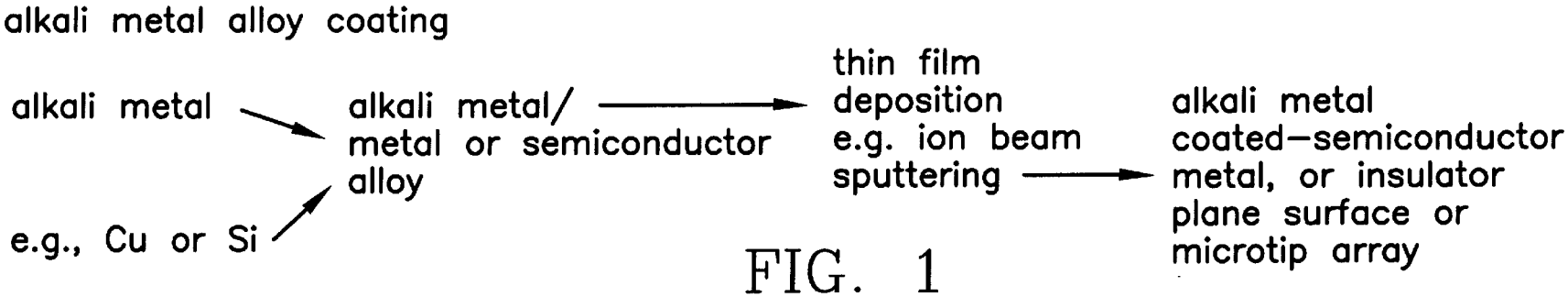
FIG. 1 is a functional flow diagram showing formation of an alkali metal alloy coating on an emission substrate by the method of thin film deposition.
Figure 2:
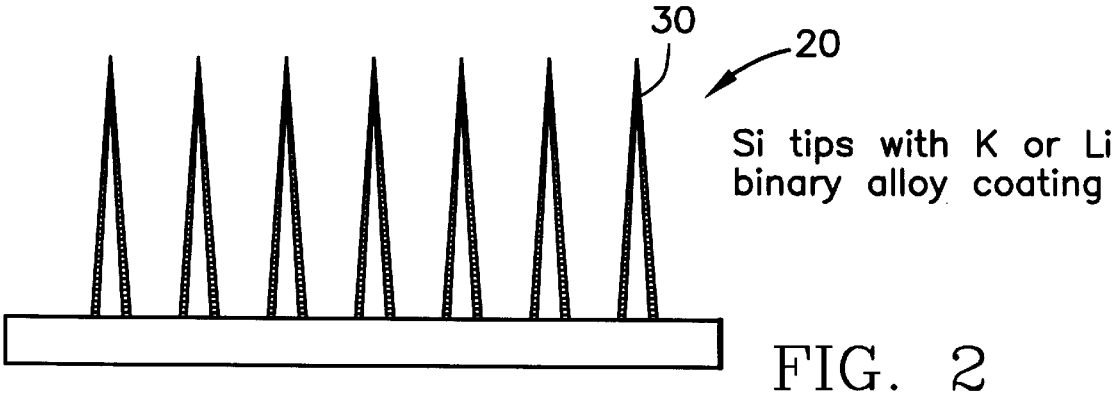
FIG. 2 shows silicon microtips with an alkali metal or Li binary alloy coating.

In the method of FIG. 1, an alkali metal alloy coating is formed in a conventional manner onto a field emission substrate 12 (see FIG. 2), such as copper, molybdenum, tungsten, GaAs, silicon, nickel or other appropriate metal substrate. The substrate can be, for example, a sharp microtip or array of such tips, ungated or gated in a diode, triode or tetrode configuration. Thus, the substrate can be prefabricated as a microtip array 20 or other desired field emission geometry, and an alloy coating 30 can be applied, for example, by a variety of means including dc and RF sputtering, magnetron sputtering, ion beam sputtering, e-beam evaporation and the like. The alloy coating can be applied to the surface from which electron field emission occurs during fabrication of the field emitter structure; however, a selective or directional deposition technique is highly preferred if the alloy coating is deposited on a field emission device with a gate electrode or lens. After deposition of the coating 30, Gibbsian segregation establishes and maintains a layer of alkali metal atoms on the surface, and this effect occurs for all the surface structures described herein. The appearance of a cross-section through the microtip array 20 and the alloy coating 30 is shown in FIG. 2.

Figure 3:
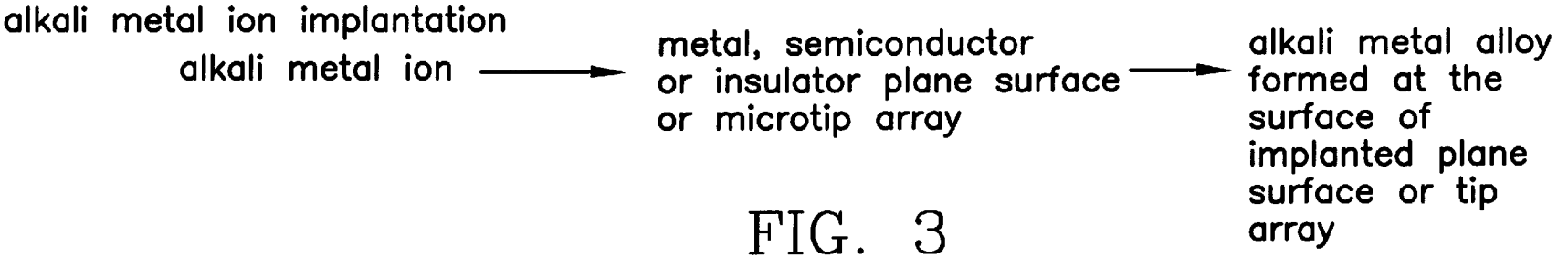
FIG. 3 is a functional flow diagram of formation of an alkali metal alloy on a semiconductor (such as Si) or metal microtip array by alkali metal ion implantation into the microtip array.
Figure 4:
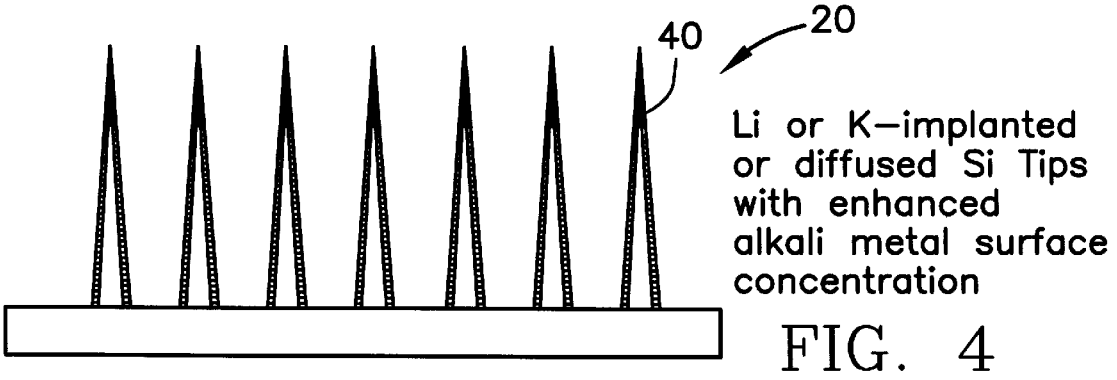
FIG. 4 shows a cross-sectional view of microtips ion implanted with Li or K or with Li or K diffused into the microtips.

In the method of FIG. 3, the prepared field emission substrate 12 (consisting of cones, ridges, sharp tips, etc.) made, for example, of copper, molybdenum, aluminum, Si, GaAs, W, or insulators is implanted with alkali metal ions forming a desired alkali metal composition coating 40 at or near the surface of the substrate from which field emission will occur. In FIG. 4 is shown the appearance of a cross-section through another microtip array 20 and the coating 40.

Figure 5:
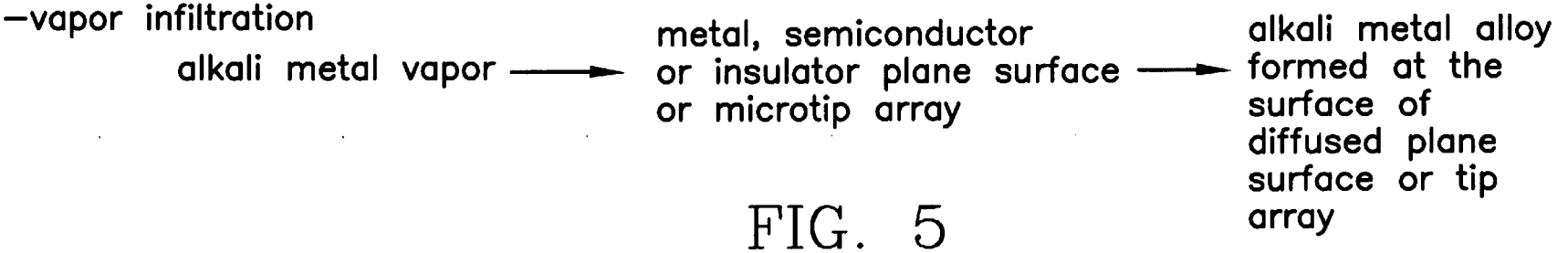
FIG. 5 is a functional flow diagram of formation of an alkali metal alloy at the surface of a microtip array by alkali metal vapor infiltration or diffusion.

In the method of FIG. 5, the field emission substrate 12, consisting of cones, ridges, microtips, etc., is treated with an alkali metal vapor (one or more elements) which is infiltrated (or diffused) into the field emission substrate 12. The alkali metal coating 40 is formed at the surface of the array 20.

Figure 8:
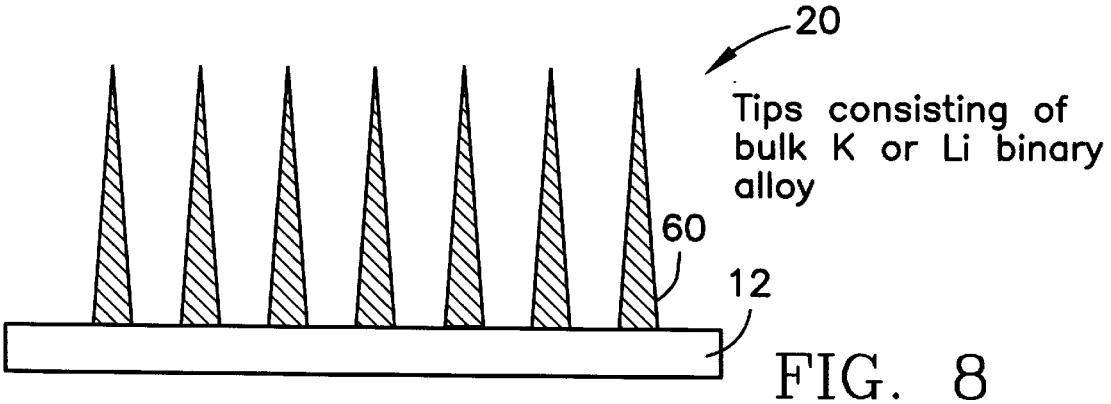
FIG. 8 illustrates a cross-sectional view of bulk microtips of K or Li alloys as they would appear after ion beam etching or by masking and lithographically etching an alkali metal alloy layer.
Figure 6:
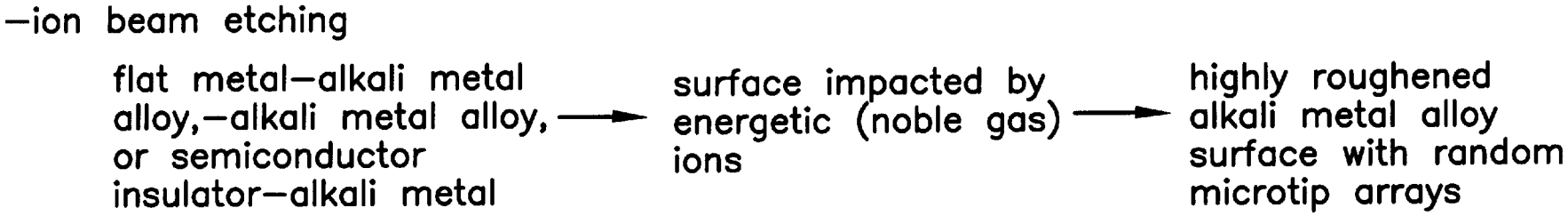
FIG. 6 is a functional flow diagram of formation of a highly roughened alkali metal alloy surface by noble gas ion beam etching of a flat metal/alkali metal alloy or alkali metal/semiconductor alloy.

In the method of FIG. 6, the field emission substrate 12 (see FIG. 8) is initially a flat metal-alkali metal alloy or Si-alkali metal alloy. An energetic ion beam, preferably an inert noble gas beam, is impacted onto the surface (such as bulk K or Li alloy) of the substrate which generates by preferential ion beam etching a roughened alkali metal alloy field emission structure (such as microtips 60 in the microtip array 20, or a cone, ridge or edge). The appearance of a cross-section through the resulting microtip array 20 is shown in FIG. 8.

Figure 7:
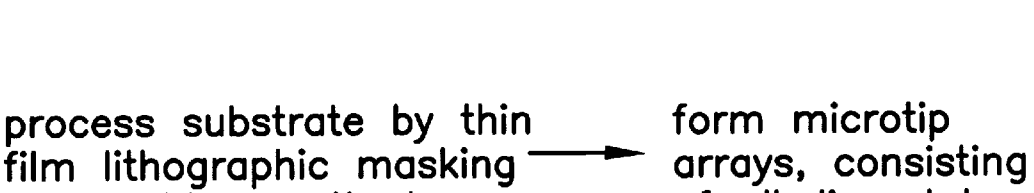
FIG. 7 is a functional flow diagram of treatment of a flat alloy of alkali metal by thin film lithographic masking and etching methods to form microtip arrays and the like of the alkali metal alloy.

In the method of FIG. 7, a thin film alkali metal alloy (such as Cu-Li or Si-Li) is deposited onto a flat substrate to form a flat metal alloy layer. The alloy is then etched using a method such as reactive ion etching or ion beam etching in conjunction with lithographic techniques to achieve the desired thickness and field emission geometry for the alkali metal alloy. The field emission microtips 60 have the appearance shown in FIG. 8.

The above-described layers, coatings, or bulk materials used to fabricate tip structures are most preferably an alloy of an alkali metal, thereby being more chemically and thermally stable in use compared to a solid alkali metal layer. If the alkali metal atoms should desorb from the surface, the underlying stable alkali metal-based alloy will provide by Gibbsian diffusion a new layer of alkali metal atoms on the surface of the field emission cathode. This mechanism will therefore maintain a stable, low work function coating on the field emission cathode structure. The surface layer of alkali metal is self-limiting, and alkali metal atom buildup ceases when the alkali metal layer is approximately one monolayer thick.

The lowered work function results in field emission properties of the field emission cathode which are enhanced at least about two orders of magnitude over an underlying field emission substrate material without the alkali metal layer. Such enhanced field emission properties also give rise to longer operating life and much better stability of emission field properties, and allow construction of quite large field emitter arrays suitable for commercial flat panel video displays.

While preferred embodiments of the invention have been shown and described, it will be clear to those skilled in the art that various changes and modifications can be made without departing from the invention in its broader aspects as set forth in the claims provided hereinafter.

What is claimed is:

1. A method of manufacturing a field emission cathode, comprising the steps of:

(a) providing a field emission substrate having an exposed surface;

(b) forming an alkali metal alloy at and below said exposed surface; and (c) forming a surface layer of alkali metal atoms on said exposed surface, said surface layer reforming upon desorption of said alkali metal ions by Gibbsian diffusion segregation action.

2. The method as defined in claim 1 wherein said field emission substrate is selected from the group consisting of silicon, copper, molybdenum, aluminum, tantalum, tungsten, GaAs and diamond.

3. The method as defined in claim 1 wherein said alkali metal alloy is formed by the step comprised of thin film deposition of an alkali metal on said substrate.

4. The method as defined in claim 1 wherein said alkali metal alloy is formed by the step comprised of alkali metal ion implantation into said substrate.

5. The method as defined in claim 1 wherein said alkali metal alloy is formed by the step comprised of alkali metal vapor infiltration into said substrate.

6. The method as defined in claim 1 wherein said alkali metal alloy is formed by the step comprised of ion beam etching of an alkali metal alloy form of said substrate to form said field emission cathode having a desired field emission geometry.

7. The method as defined in claim 1 wherein said alkali metal alloy is formed by the step comprised of depositing a thin film alkali metal alloy onto a substrate and lithographically etching said substrate to expose a desired geometry of said alkali metal alloy.

8. The method as defined in claim 1 wherein said alkali metal alloy is formed by the step comprised of forming a thin film by one of the group consisting of laser beam ablation of an alkali metal alloy onto said substrate, RF, dc, magnetron and ion beam sputtering of an alkali metal alloy onto said substrate, thermal evaporation of an alkali metal alloy onto said substrate and chemical vapor deposition of an alkali metal alloy onto said substrate.

9. The method as defined in claim 1 wherein said field emission substrate consists essentially of a metal.

10. The method as defined in claim 1 wherein said field emission substrate comprises at least one microtip.

11. The method as defined in claim 1 wherein said alkali metal alloys are selected from the group consisting of Cu-Li, Al-Li and Si-Li.

12. An article of manufacture of a field emission cathode, comprising:

a field emission substrate having an exposed surface;

an alkali metal alloy disposed below said exposed surface; and a monolayer of alkali metal disposed on said exposed surface.

* * * * *